US011333380B2

(12) United States Patent
Weinert

(10) Patent No.: US 11,333,380 B2
(45) Date of Patent: May 17, 2022

(54) HEATING, VENTILATION, AND AIR CONDITIONING COMBUSTION SUPPRESSION SYSTEM

(71) Applicant: Johnson Controls Technology Company, Auburn Hills, MI (US)

(72) Inventor: Jamie T. Weinert, Marinette, WI (US)

(73) Assignee: Johnson Controls Tyco IP Holdings LLP, Milwaukee, WI (US)

( * ) Notice: Subject to any disclaimer, the term of this patent is extended or adjusted under 35 U.S.C. 154(b) by 747 days.

(21) Appl. No.: 15/880,230

(22) Filed: Jan. 25, 2018

(65) Prior Publication Data

US 2019/0170382 A1 Jun. 6, 2019

Related U.S. Application Data

(60) Provisional application No. 62/593,312, filed on Dec. 1, 2017.

(51) Int. Cl.

| | |
|---|---|
| ***A62C 35/58*** | (2006.01) |
| ***F24F 11/34*** | (2018.01) |
| ***F24F 11/00*** | (2018.01) |
| ***F24F 11/36*** | (2018.01) |

(52) U.S. Cl.

CPC ..... *F24F 11/34* (2018.01); *A62C 35/58* (2013.01); *F24F 11/0001* (2013.01); *F24F 11/36* (2018.01)

(58) Field of Classification Search

CPC ..... F24F 11/34; F24F 11/36; F24F 11/0001; A62C 35/58

USPC ..... 169/60

See application file for complete search history.

(56) References Cited

U.S. PATENT DOCUMENTS

| | | | | |
|---|---|---|---|---|
| 4,047,571 | A | 9/1977 | Chaintrier et al. | |
| 9,089,727 | B1 | 7/2015 | Flood | |
| 9,919,169 | B2 * | 3/2018 | Lewinski | A62C 37/44 |
| 2002/0023762 | A1 * | 2/2002 | Kotliar | B01D 53/02 169/54 |
| 2009/0168345 | A1 * | 7/2009 | Martini | H05K 7/20745 361/691 |
| 2009/0211773 | A1 * | 8/2009 | Gooch | A62C 3/16 169/46 |

(Continued)

FOREIGN PATENT DOCUMENTS

| | | | | |
|---|---|---|---|---|
| CN | 1392944 A | * | 1/2003 | F24F 11/02 |
| WO | 2008150098 A2 | | 12/2008 | |

(Continued)

OTHER PUBLICATIONS

平良繁治 Shigeharu Taira et al., English translation of CN1392944A from Google patents, Jan. 22, 2003, (Year: 2003).*

*Primary Examiner* — Chee-Chong Lee

(74) *Attorney, Agent, or Firm* — Fletcher Yoder, P.C.

(57) ABSTRACT

A heating ventilation and air conditioning (HVAC) combustion suppression system. The HVAC combustion suppression system includes a sensor that detects and emits a signal indicative of a refrigerant released from an HVAC system into an enclosed space. The system also includes a suppression component that blocks or reduces combustion of the refrigerant in the enclosed space, and a controller that receives the signal from the sensor. The controller in response to the signal activates the suppression component to suppress combustion of the refrigerant in the enclosed space.

14 Claims, 7 Drawing Sheets

(56) References Cited

U.S. PATENT DOCUMENTS

| | | | | |
|---|---|---|---|---|
| 2012/0031633 | A1* | 2/2012 | Su | A62C 99/0018 169/61 |
| 2012/0073840 | A1* | 3/2012 | Prieur | A62C 3/16 169/46 |
| 2013/0025888 | A1* | 1/2013 | Eckholm | A62C 37/44 169/46 |
| 2015/0144311 | A1 | 5/2015 | Grabon | |

FOREIGN PATENT DOCUMENTS

| | | | |
|---|---|---|---|
| WO | 2016146885 | A1 | 9/2016 |
| WO | 2017120539 | A1 | 7/2017 |

* cited by examiner

HEATING, VENTILATION, AND AIR CONDITIONING COMBUSTION SUPPRESSION SYSTEM

CROSS REFERENCE TO RELATED APPLICATIONS

This application claims priority from and the benefit of U.S. Provisional Application Ser. No. 62/593,312, entitled "HEATING, VENTILATION, AND AIR CONDITIONING COMBUSTION SUPPRESSION SYSTEM," filed Dec. 1, 2017, which is hereby incorporated by reference in its entirety for all purposes.

BACKGROUND

The disclosure relates generally to HVAC systems.

Heating, ventilation, and air conditioning (HVAC) systems cool enclosed spaces by exchanging energy between a refrigerant and air. HVAC systems do this by circulating a refrigerant between two heat exchangers commonly referred to as an evaporator coil and a condenser coil. As refrigerant passes through the evaporator coil and the condenser coil, the refrigerant either absorbs or discharges thermal energy. More specifically, as air passes over the evaporator coil, the air cools as it loses energy to the refrigerant passing through the evaporator coil. In contrast, the condenser enables the refrigerant to discharge heat into the atmosphere. Inasmuch as refrigerant leaks compromise system performance or result in increased costs, it is accordingly desirable to provide detection and response systems and methods for the HVAC system to reliably detect and respond to any refrigerant leaks of the HVAC system.

SUMMARY

The present disclosure relates to a heating ventilation and air conditioning (HVAC) combustion suppression system. The HVAC combustion suppression system includes a sensor that detects a refrigerant released from an HVAC system into an enclosed space and emits a signal indicative of the refrigerant. The system also includes a suppression component that blocks or reduces combustion of the refrigerant in the enclosed space, and a controller that receives the signal from the sensor. The controller in response to the signal actuates the suppression component to suppress combustion of the refrigerant in the enclosed space.

The present disclosure also relates to a heating ventilation and air conditioning (HVAC) combustion suppression system. The HVAC combustion suppression system includes a sensor that detects and emits a signal indicative of a combustion event in an enclosed space. The system also includes a suppression component that extinguishes the combustion event, and a controller that receives the signal from the sensor. The controller in response to the signal activates the suppression component to extinguish the combustion event in the enclosed space.

The present disclosure also relates to a heating ventilation and air conditioning (HVAC) safety system that includes a sensor that detects and emits a signal indicative of a refrigerant and/or combustion in an enclosed space. The HVAC safety system also includes an electronic device and a controller that receives the signal from the sensor and transmits a warning message to the electronic device.

DRAWINGS

DETAILED DESCRIPTION

Embodiments of the present disclosure include an HVAC combustion suppression system that blocks and/or reduces combustion of a refrigerant as well as extinguishes combustion events. The HVAC combustion suppression system may include one or more sensors that detect the presence of a refrigerant and communicate this information to a controller. The controller may then compare the signal indicative of a concentration level of a refrigerant to a threshold level. If the concentration level of the refrigerant is above the threshold level, the controller may activate one or more suppression components to block and/or reduce combustion of the refrigerant. The controller may also receive feedback from one or more sensors capable of sensing combustion. In response, the controller may activate one or more suppression components to reduce the size of and/or extinguish the combustion event. By blocking and/or reducing combustion of a refrigerant as well as extinguishing a combustion event, the HVAC combustion suppression system may increase the safety of an HVAC system using a refrigerant.

Figure 1:
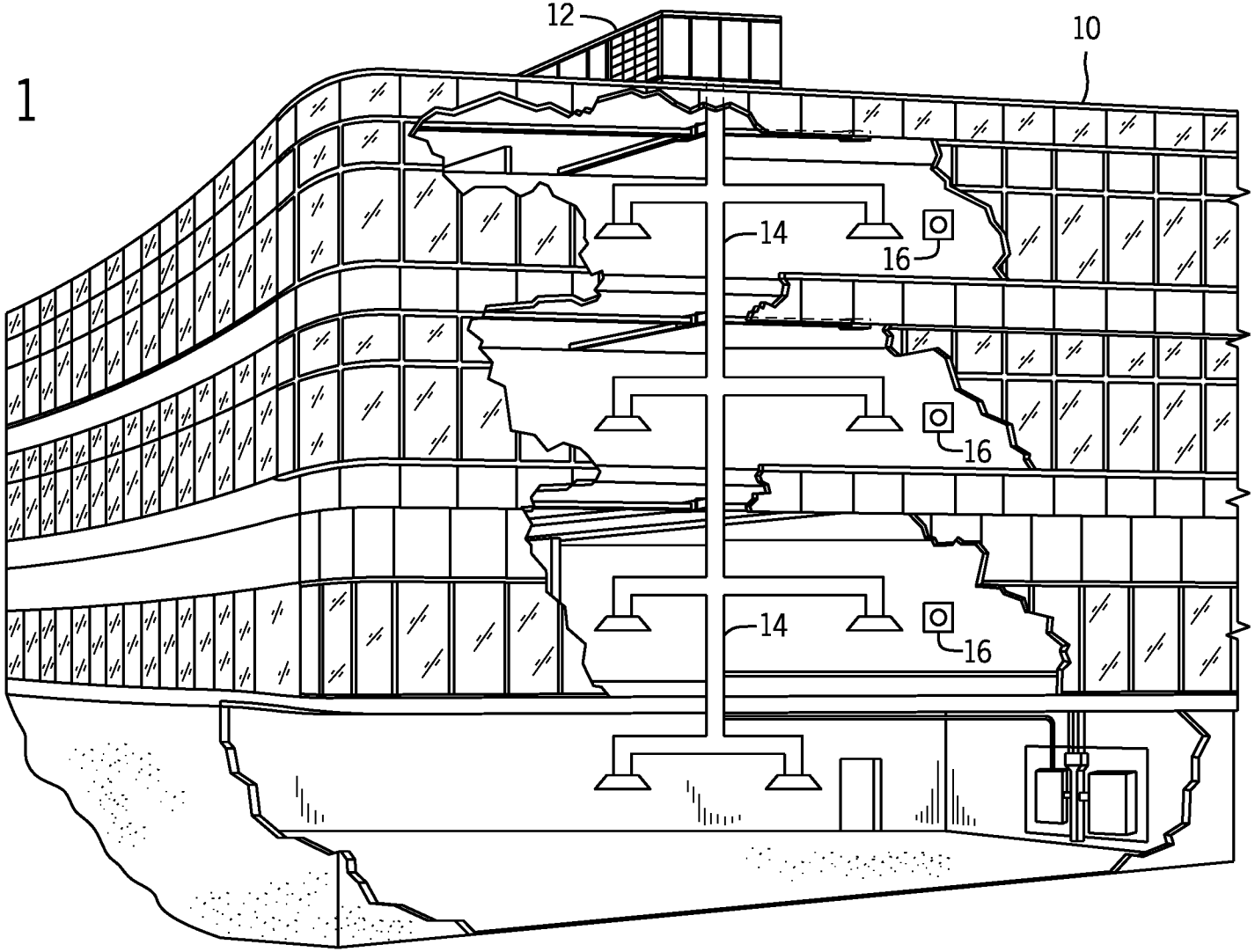
FIG. 1 is a perspective view of an embodiment of a building that may utilize a heating, ventilation, and air conditioning (HVAC) system in a commercial setting, in accordance with an aspect of the present disclosure.

Turning now to the drawings, FIG. 1 illustrates a heating, ventilating, and air conditioning (HVAC) system for building environmental management that may employ one or more HVAC units. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air-cooled device that implements a refrigeration cycle to provide conditioned air to the building 10. Specifically, the HVAC unit 12 may include one or more heat exchangers across which an airflow is passed to condition the airflow before the airflow is supplied to the building. In the illustrated embodiment, the HVAC unit 12 is a rooftop unit (RTU) that conditions a supply air stream, such as environmental air and/or a return airflow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
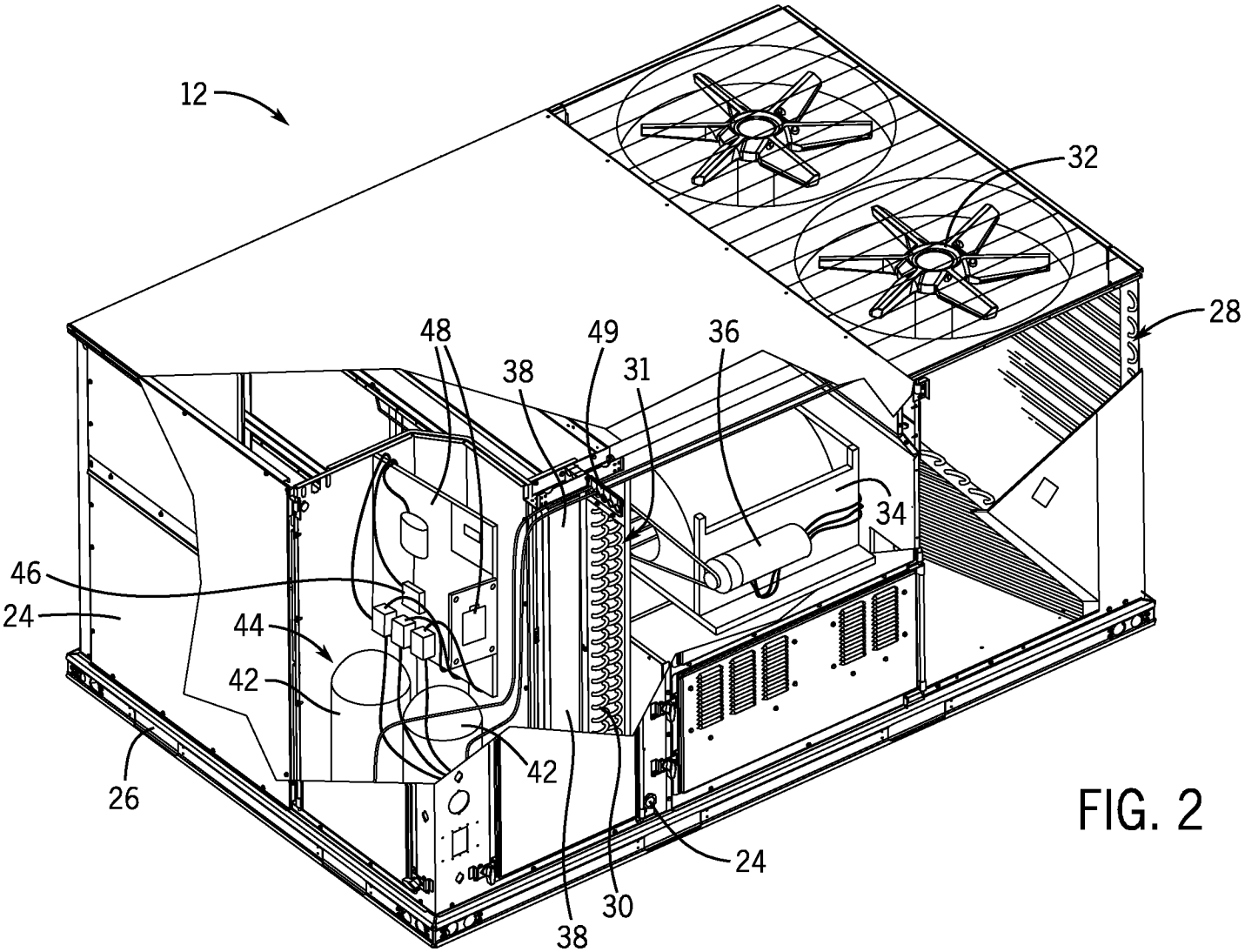
FIG. 2 is a perspective view of an embodiment of an HVAC unit of the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant through the heat exchangers 28 and 30. For example, the refrigerant may be R-410A. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned airflows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive him arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
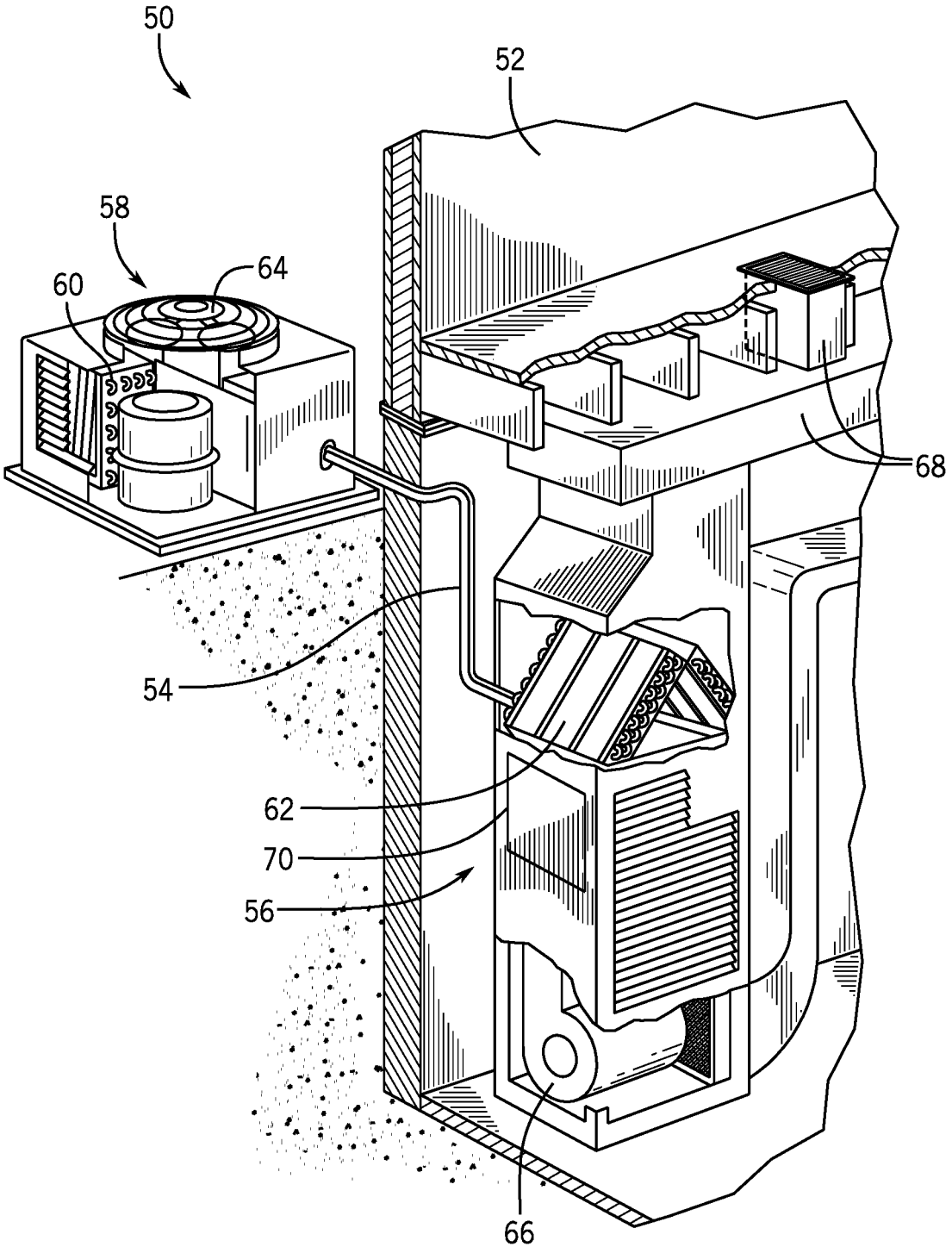
FIG. 3 is a perspective view of an embodiment of a residential, split HVAC system that includes an indoor HVAC unit and an outdoor HVAC unit, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
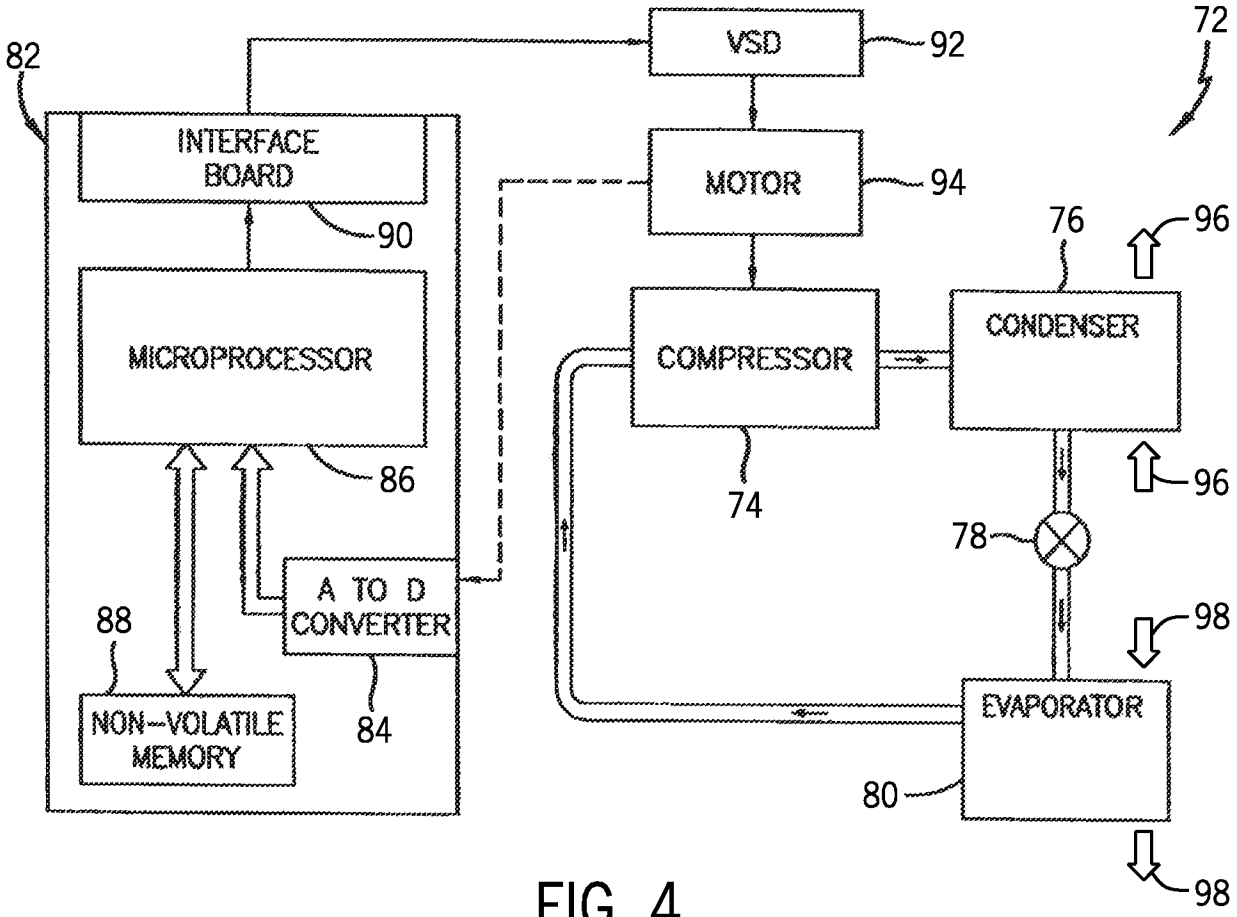
FIG. 4 is a schematic of an embodiment of an HVAC system, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
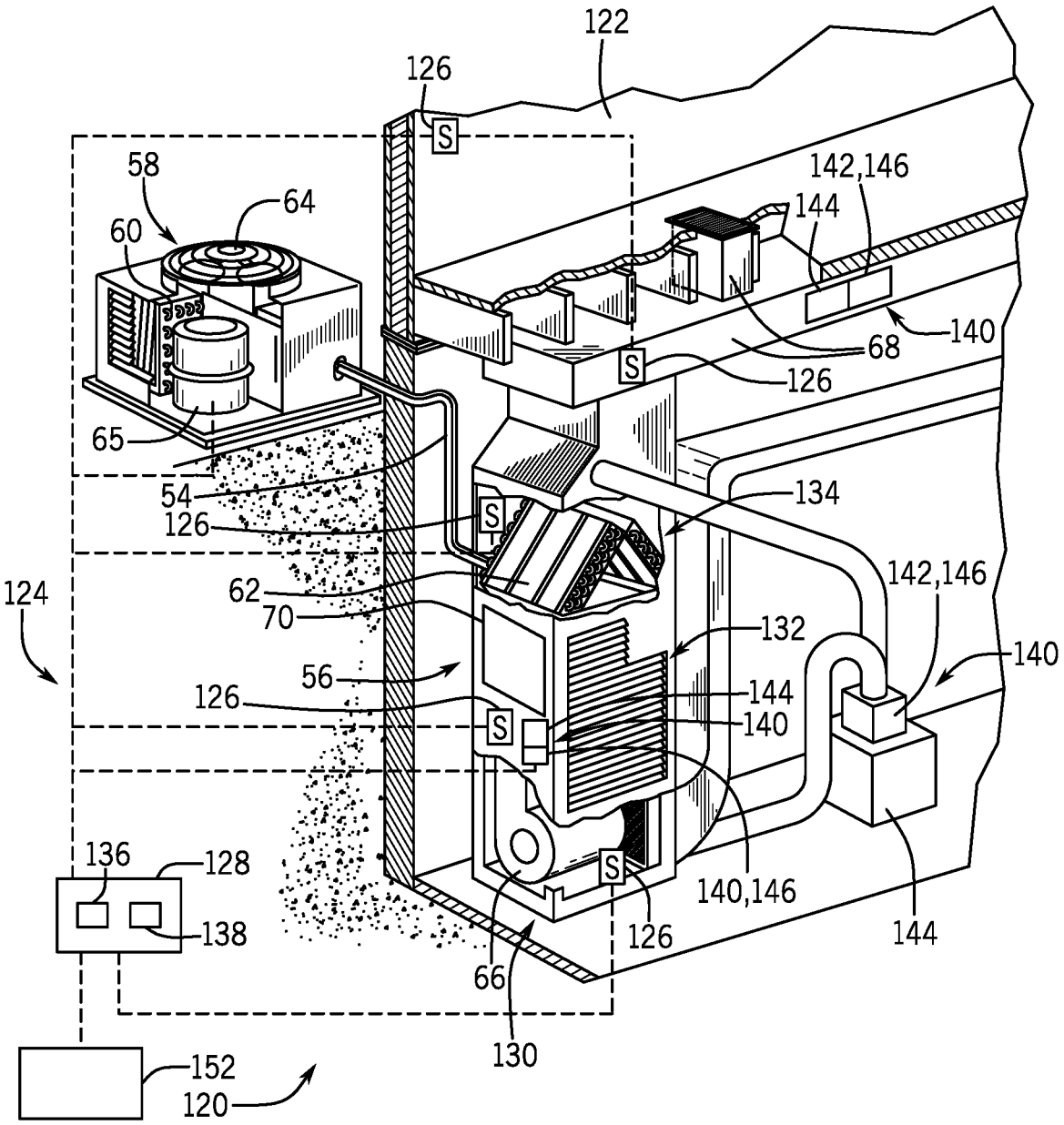
FIG. 5 is a perspective view of an embodiment of a split HVAC system with an HVAC combustion suppression system, in accordance with an aspect of the present disclosure.

FIG. 5 is a schematic view of an embodiment of a split HVAC system 120 that uses a desired refrigerant. The refrigerant being classified as numerically equal to or greater than the refrigerants A2L or B2L according to the ISO 817 refrigerant classification scheme. For example, the refrigerant may be an A2L, B2L, A2, B2, A3, or B3 refrigerant accordingly to the ISO 817 refrigerant classification scheme. Because the HVAC system 120 uses a refrigerant to cool an enclosed space 122, the HVAC system 120 includes an HVAC combustion suppression system 124 capable of blocking and/or reduces combustion of the refrigerant as well as reducing and/or extinguishing a combustion event. Examples of an enclosed space 122 include a home, apartment, office building.

The HVAC system 120 may be a split system with refrigerant conduits 54 that couple the indoor unit 56 to the outdoor unit 58. The refrigerant conduits 54 transfer the refrigerant between the indoor unit 56 and the outdoor unit 58, primarily transferring liquid refrigerant in one direction and vaporized refrigerant in an opposite direction.

A heat exchanger 60 in the outdoor unit 58 serves as a condenser for re-condensing vaporized refrigerant flowing from the indoor unit 56 to the outdoor unit 58 via one of the refrigerant conduits 54, while a heat exchanger 62 of the indoor unit 56 functions as an evaporator. During operation, the liquid refrigerant in the heat exchanger 62 absorbs energy causing it to evaporate. After passing through the heat exchanger 62, the evaporated refrigerant is redirected to the outdoor unit 58 where a fan 64 draws air over the heat exchanger 60 enabling the vaporized refrigerant to condense by rejecting heat to the atmosphere. The heat transfer cycle then begins again as the liquid refrigerant is pumped with the compressor 65 back to the heat exchanger 62 where it again absorbs energy from air blown by the blower 66. The cooled air is then carried through one or more air ducts 68 to various areas of the enclosed space 122.

In some embodiments, the indoor unit 56 may include the furnace system 70. The furnace system 70 may include a burner assembly and heat exchanger, among other components. In some embodiments, the furnace system 70 combusts a fuel, such as natural gas, to generate heat. The combustion products may pass through tubes or piping in a heat exchanger, separate from heat exchanger 62, such that air directed by the blower 66 passing over the tubes or pipes absorbs heat from the combustion products. The heated air may then be routed from the furnace system 70 to the ductwork 68 for heating the enclosed space 122. In some embodiments, the furnace 70 may not combust a fuel, but may instead use electrical energy to heat air blown by the blower 66.

The HVAC system 120 includes an HVAC combustion suppression system 124 that blocks, reduces, and/or extinguishes combustion events. The HVAC combustion suppression system 124 includes one or more sensors 126 capable of sensing the presence of the refrigerant and/or a burning refrigerant and transmitting a signal(s) indicative of the condition to a controller 128. The sensors 126 may be positioned in various locations on the indoor unit 56 and/or in the enclosed space 122. For example, the HVAC combustion suppression system 124 may include sensors 126 in air ducts 68, in one or more rooms of the enclosed space 122, as well as sensors in the indoor unit 56. The sensors 126 within the indoor unit 56 may be upstream as well as downstream from the heat exchanger 62. As illustrated, the indoor unit 56 includes a sensor 126 in a blower compartment 130, a furnace compartment 132, and in a heat exchanger compartment 134. The types of sensors 126 used to detect concentrations of the refrigerant may include electrochemical, catalytic bead, photoionization, infrared point, infrared imaging, semiconductor, ultrasonic, holographic.

The controller 128 may include a processor 136 and a memory 138 used in processing one or more signals from one or more sensors 126. For example, the processor 136 may be a microprocessor that executes software to control the HVAC combustion suppression system 124. The processor 136 may include multiple microprocessors, one or more "general-purpose" microprocessors, one or more special-purpose microprocessors, and/or one or more application specific integrated circuits (ASICS), or some combination thereof. For example, the processor 136 may include one or more reduced instruction set (RISC) processors.

The memory 138 may include a volatile memory, such as random access memory (RAM), and/or a nonvolatile memory, such as read-only memory (ROM). The memory 138 may store a variety of information and may be used for various purposes. For example, the memory 138 may store processor executable instructions, such as firmware or software, for the processor 136 to execute. The memory may include ROM, flash memory, a hard drive, or any other suitable optical, magnetic, or solid-state storage medium, or a combination thereof. The memory may store data, instructions and any other suitable data.

In operation, one or more sensors 126 send signals indicative of the refrigerant concentration to a controller 128. The controller 128 receives and interprets the signals, and then compares the detected concentration of refrigerant to a threshold concentration. The controller 128 compares the detected concentration of refrigerant to the threshold concentration to determine whether the detected concentration of refrigerant is capable of combustion. If the concentration is incapable of combustion, the controller 128 may continue to monitoring feedback from the sensors 126. However, if the concentration is capable of combustion, the controller 128 may activate one or more suppression components 140 to reduce and/or block combustion of the refrigerant from an energy source.

The suppression components 140 may be placed at one or more locations in the HVAC system 102 and/or enclosed space 122. For example, the suppression components 140 may couple to the indoor unit 58, be placed within one or more compartments of the indoor unit 58, be placed within one or more air ducts 68. By including multiple suppression components, the HVAC combustion suppression system 124 enables a focused/tailored response to detection of a combustion event and/or detection of a refrigerant concentration above a threshold level.

In some embodiments, the suppression component 140 may be a pump 142 that pumps an inert gas, such as nitrogen, from an inert gas supply 144, such as a tank, into the HVAC system 120. The inert gas acts as a combustion suppressant by reducing the percentage of oxygen available for combustion in vicinity of the refrigerant. In addition to reducing the oxygen concentration, the inert gas may also facilitate dispersion of the refrigerant to a concentration level that is incapable of combusting. In some embodiments, one or more of the sensors 126 may detect the concentration of oxygen in the air enabling the controller 128 to lower the oxygen concentration with the inert gas to a level that blocks and/or reduces combustion of the refrigerant while simultaneously maintaining the oxygen at a level suitable for humans.

The pump 142 may pump the inert gas upstream and/or downstream from the heat exchanger 62, and/or into the heat exchanger compartment 134. For example, the pump 142 may pump the inert gas into the HVAC system 120 upstream from the blower 66 enabling the blower 66 to suck/draw the inert gas into the indoor unit 56. The blower 66 may then blow the inert gas through the indoor unit 56 to suppress combustion of the refrigerant within the indoor unit 56 or downstream of the indoor unit 56. In some embodiments, the pump 142 may pump the inert gas upstream of the heat exchanger 62. For example, the pump 142 may pump the inert gas into the air ducts 68 and/or into the rooms fed by the air ducts 68.

In some embodiments, the pump 142 may pump a dry chemical from a dry chemical supply 144 into the HVAC system 120. Like the inert gas, the dry chemical blocks combustion of the refrigerant by inhibiting the combustion reaction. The pump 142 may pump the dry chemical upstream and/or downstream from the heat exchanger compartment 134, and/or into the heat exchanger compartment 134. For example, the pump 142 may pump the dry chemical into the HVAC system 120 upstream from the blower 66 enabling the blower 66 to suck/draw the dry chemical into the indoor unit 56. The blower 66 may then blow the inert gas through the indoor unit 56 to suppress combustion of the refrigerant within the indoor unit 56 or downstream of the indoor unit 56.

In some embodiments, the suppression component 140 may be a valve 146 that releases a compressed inert gas from an inert gas supply 144, such as a tank. The inert gas may be released upstream from the heat exchanger compartment 134, downstream from the heat exchanger compartment 134, and/or into the heat exchanger compartment 134. For example, the valve 146 may release the inert gas into the HVAC system 120 upstream from the blower 66 enabling the blower 66 to suck/draw the inert gas into the indoor unit 56. The blower 66 may then blow the inert gas through the indoor unit 56 to suppress combustion of the refrigerant within the indoor unit 56 or downstream of the indoor unit 56.

In some embodiments, the valve 146 may release a dry chemical from a dry chemical supply 144 for use in suppressing combustion of the refrigerant. For example, when the valve 146 opens the blower 66 may draw the dry chemical from the dry chemical supply 144 and blow it through the HVAC system 120 to suppress combustion of the refrigerant.

In some embodiments, the suppression component 140 is the blower 66. The blower 66 may act as a suppression component 140 by reversing the direction in which it blows in order to suck the refrigerant out of the HVAC system 120 and discharging it into the atmosphere. In other words, the blower 66 may draw the refrigerant out of the HVAC system 120 in order to reduce the concentration of the refrigerant to a level where it can no longer ignite.

As explained above, the HVAC combustion suppression system 124 may also use sensors 126 that detects burning refrigerant, and in response sends a signal to the controller 128. In some embodiments, the sensor 126 may be a chemical sensor capable of detecting the combustion products of the refrigerant and/or combustion products produced by a combustion event. In some embodiments, the sensor 126 may be a sensor capable of detecting energy emissions such as an optical sensor, infrared sensor. It should also be understood that the HVAC combustion suppression system 124 may use a combination of sensors to detect a combustion event. For example, the HVAC combustion suppression system 124 may use multiple sensors 126 to verify the existence of a combustion event, cross-reference, before engaging one or more suppression components 140 that disperse a dry chemical, an inert gas.

The controller 128 may communicate through wireless and/or wired networks with one or more electronic devices 152. That is, the controller 128 may provide updates and/or receive input from a user through electronic devices 152. The electronic devices 152 may be a cell phone, laptop, smart thermostat, tablet, watch. For example, the controller 128 may provide a warning to a user that refrigerant has leaked into the enclosed space 122 or that a combustion event has been detected. The warning may be provided in a variety ways including as a written message on a display of an electronic device 152, an audio message, a warning sound, flashing lights, or combinations thereof.

The controller 128 may also request feedback from the user through electronic device 152. For example, the controller 128 may request confirmation before deploying the dry chemical, the inert gas, or a combination thereof. The requested feedback may also include confirming shutoff of the compressor 65 and/or the blower 66 to reduce spreading the refrigerant or introducing more refrigerant into the enclosed space 122.

Figure 6:
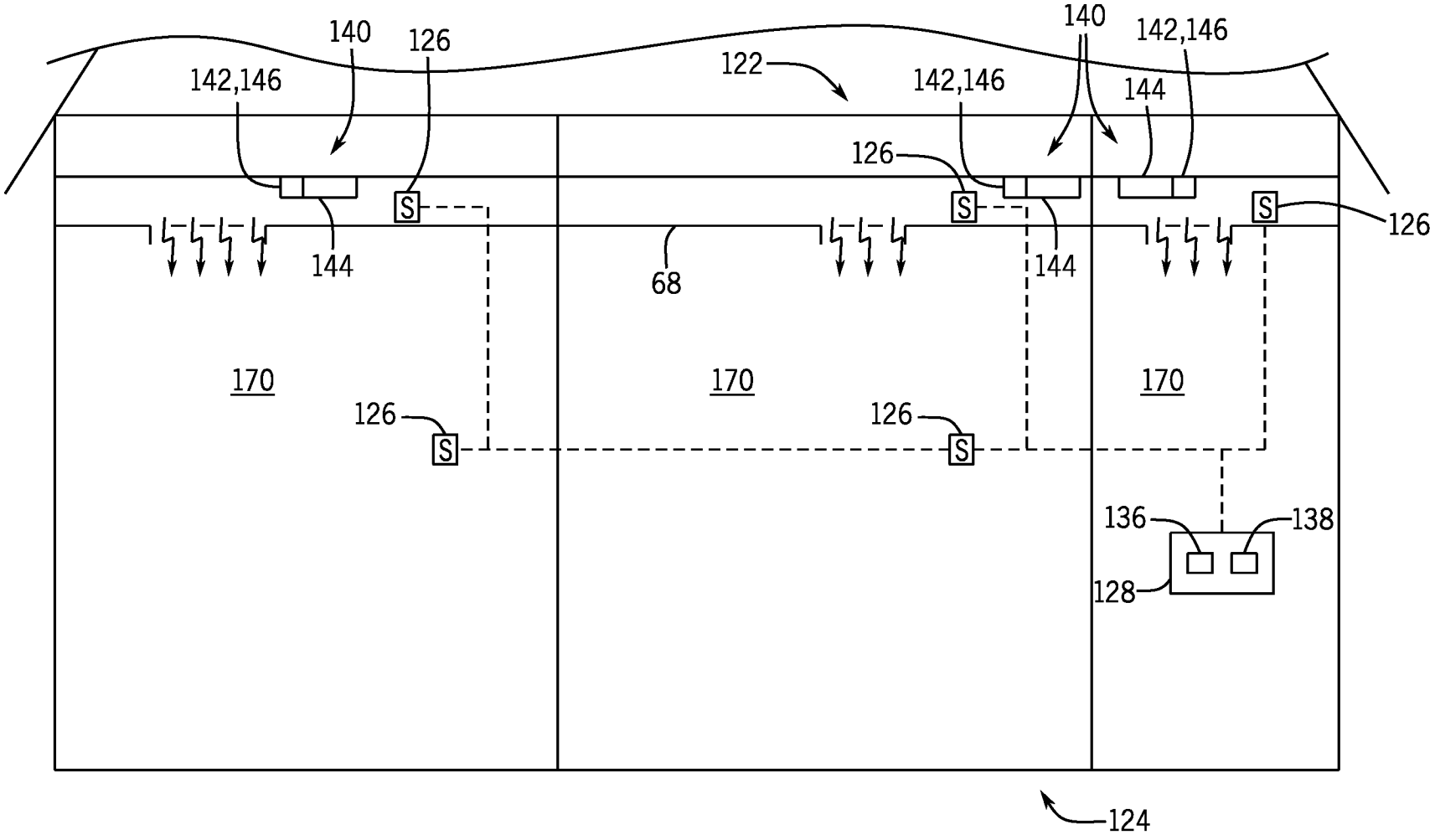
FIG. 6 is a schematic view of an embodiment of an HVAC combustion suppression system, in accordance with an aspect of the present disclosure.

FIG. 6 is a schematic view of an embodiment of an HVAC combustion suppression system 124. As explained above, the HVAC combustion suppression system 124 controls one or more suppression components 140 to reduce/block combustion of a refrigerant and/or extinguish a combustion event. As illustrated, the enclosed space 122 may include one or more rooms 170. Instead of injecting inert gas and/or dry chemicals into each room 170, air duct 68, and/or compartment of the indoor unit 58, the controller 128 may be programmed to inject the inert gas and/or dry chemicals into a subset/portion of the enclosed space 122 depending on the detected location of the refrigerant and/or combustion event. For example, one of the rooms 170 may have a concentration of refrigerant capable of combustion or an actual combustion event. Accordingly, the controller 128 may only activate the suppression component 140 closest to the problem area.

Figure 7:
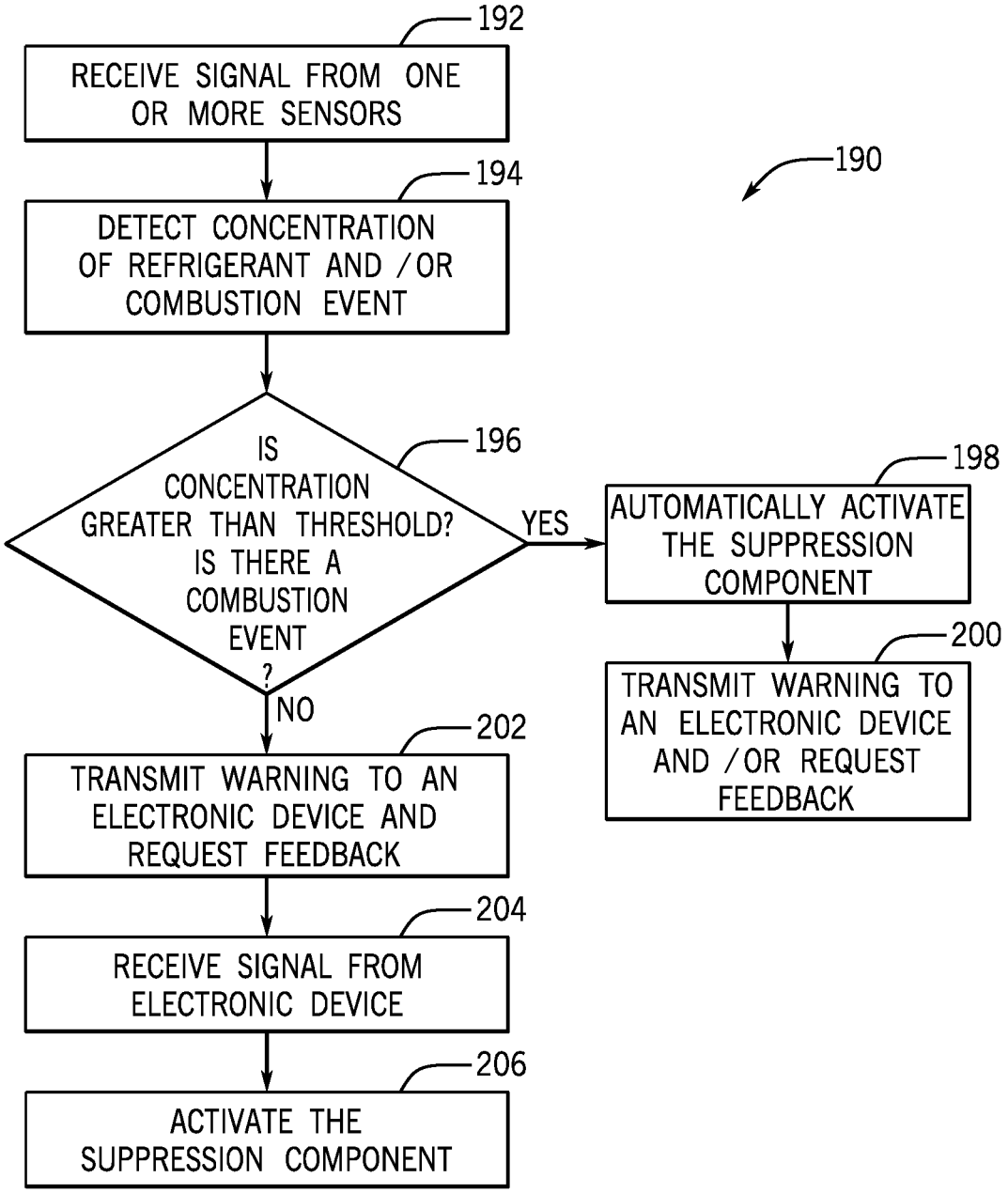
FIG. 7 illustrates a flow chart of a method for controlling an HVAC combustion suppression system, in accordance with an aspect of the present disclosure.

FIG. 7 illustrates a flow chart 190 of a method for controlling an HVAC combustion suppression system 124. The method begins as the controller 128 receives signals from one or more sensors 126, as indicated by step 192. The signals from the sensors 126 are indicative of a concentration of refrigerant in an enclosed space 122 and/or a detection of a combustion event. The controller 128 receives the one or more signals from the sensors 126 to determine/detect the concentration of the refrigerant and/or combustion, as indicated by step 194. The controller 128 then determines if the concentration of the refrigerant is greater than a threshold, such as a concentration capable of combusting, and/or if there is a combustion event, as indicated by step 196. If the answer is yes to either question, the controller 128 may activate one or more suppression components 140 to inhibit combustion of the refrigerant and/or extinguish a combustion event, as indicated by step 198. The controller 128 may then transmit a warning to the electronic device 152 and/or request feedback from a user through the electronic device 152, as indicated by step 200. As explained above, in some embodiments the requested feedback from the controller 128 may include confirmation to activate one or more suppression components. The requested feedback may also include a request for the user to designate which suppression components 140 to activate.

If the concentration is less than the threshold and no combustion is detected, the controller 128 may still transmit a warning to an electronic device 152 advising a user that there is a leak of refrigerant in the enclosed space 122, as indicated by step 202. In some embodiments, the controller 128 may request feedback from the user regarding activation of one or more suppression components 140. The controller 128 receives the feedback from the electronic device 152 as a signal indicating a command to activate one or more suppression components 140, as indicated by step 204. In response to the signal, the controller 128 may activate one or more suppression components 140 to block and/or reduce combustion of the refrigerant, as indicated by step 206.

While only certain features and embodiments of the disclosure have been illustrated and described, many modifications and changes may occur to those skilled in the art without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed subject matter. It should be appreciated that in the development of any such actual implementation, as in any engineering or design project, numerous implementation specific decisions may be made. Such a development effort might be complex and time consuming, but would be a routine undertaking of design, fabrication, and manufacture for those of ordinary skill having the benefit of this disclosure, without undue experimentation.

The invention claimed is:

1. A heating, ventilation, and air conditioning (HVAC) combustion suppression system, comprising:

an air duct fluidly coupled with a heat exchanger of an HVAC system and configured to guide supply of conditioned air having a first chemical composition from the heat exchanger to a plurality of rooms of a building;

a sensor configured to detect a refrigerant released from the HVAC system into the air duct or into a room of the plurality of rooms and to emit a signal indicative of the refrigerant;

a suppression component configured to release a combustion suppressant having a second chemical composition different than the first chemical composition into the air duct to suppress or preclude combustion of the refrigerant in the air duct and in the room; and a controller configured to:

operate the HVAC system in an air conditioning mode such that the air duct guides the supply of the conditioned air from the heat exchanger to the plurality of rooms;

receive the signal from the sensor; and actuate the suppression component to release the combustion suppressant into the air duct in response to the signal.

2. The HVAC combustion suppression system of claim 1, wherein the controller is configured to actuate the suppression component in response to a detected concentration of the refrigerant exceeding a threshold concentration.

3. The HVAC combustion suppression system of claim 1, wherein the suppression component comprises:

a blower configured to direct the conditioned air through the air duct; and a valve configured to control release of the combustion suppressant from a container, wherein, in response to receiving the signal, the controller is configured to open the valve and actuate the blower to draw the combustion suppressant from the container into the air duct via the valve.

4. The HVAC combustion suppression system of claim 1, wherein the suppression component comprises a pump, the combustion suppressant comprises an inert gas from an inert gas supply, and the controller is configured to operate the pump based on the signal to release the inert gas into the air duct.

5. The HVAC combustion suppression system of claim 1, wherein the suppression component comprises a valve, the combustion suppressant comprises a dry chemical from a dry chemical supply, and the controller is configured to operate the valve based on the signal to release the dry chemical into the air duct.

6. The HVAC combustion suppression system of claim 1, wherein the sensor is a chemical sensor, an optical sensor, or both.

7. The HVAC combustion suppression system of claim 1, wherein the sensor is a first sensor, and the HVAC combustion suppression system comprises a second sensor configured to detect combustion of the refrigerant.

8. The HVAC combustion suppression system of claim 7, wherein the first and second sensors are coupled to the air duct upstream from an evaporator coil of the HVAC system.

9. The HVAC combustion suppression system of claim 1, comprising an additional sensor configured to detect a combustion event in the air duct or the room and to emit an additional signal indicative of the combustion event, wherein the controller is configured to receive the additional signal and actuate the suppression component in response to receiving the additional signal.

10. The HVAC combustion suppression system of claim 1, wherein the controller is configured to receive the signal from the sensor and transmit a warning message to an electronic device in response to receiving the signal, and wherein the electronic device comprises a mobile electronic device, a thermostat, a computer, or a combination thereof.

11. The HVAC combustion suppression system of claim 10, wherein the warning message comprises an audible tone, a written message, an audible message, a flashing light, or both.

12. The HVAC combustion suppression system of claim 1, wherein the controller comprises a processor and a memory, wherein, in response to receiving the signal and prior to actuating the suppression component, the processor is configured to transmit a warning message to an electronic device, wherein the warning message comprises a prompt requesting user input indicative of a command to activate the suppression component.

13. The HVAC combustion suppression system of claim 12, wherein the processor is configured to activate the suppression component upon receipt of the user input via the electronic device.

14. The HVAC combustion suppression system of claim 1, wherein the sensor is disposed in the air duct.

* * * * *